US008162163B2

(12) United States Patent
Matsuo et al.

(10) Patent No.: US 8,162,163 B2
(45) Date of Patent: Apr. 24, 2012

(54) SYNTHETIC RESIN HANDLE FOR USE WITH A BOTTLE

(75) Inventors: Yoshinori Matsuo, Tokyo (JP); Junichi Itokawa, Tokyo (JP); Takao Iizuka, Tokyo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 296 days.

(21) Appl. No.: 12/448,245

(22) PCT Filed: Dec. 7, 2007

(86) PCT No.: PCT/JP2007/073642

§ 371 (c)(1),
(2), (4) Date: Aug. 10, 2009

(87) PCT Pub. No.: WO2008/081681

PCT Pub. Date: Jul. 10, 2008

(65) Prior Publication Data

US 2010/0282708 A1 Nov. 11, 2010

(30) Foreign Application Priority Data

Dec. 27, 2006 (JP) ..... 2006-351297

(51) Int. Cl.
*B65D 23/10* (2006.01)

(52) U.S. Cl. ..... 215/396; 215/398

(58) Field of Classification Search ..... 215/396, 215/398; 294/27.1–34; D7/622
See application file for complete search history.

(56) References Cited

U.S. PATENT DOCUMENTS

| | | | | |
|---|---|---|---|---|
| 3,923,191 | A * | 12/1975 | Johnson | 220/760 |
| 5,167,970 | A * | 12/1992 | Yoshino et al. | 425/525 |
| 5,535,901 | A * | 7/1996 | Ishii et al. | 215/396 |
| 6,049,945 | A * | 4/2000 | Prevot et al. | 16/110.1 |
| 6,223,397 | B1 * | 5/2001 | Prevot et al. | 16/444 |
| 2006/0021960 | A1 * | 2/2006 | Itokawa et al. | 215/398 |

FOREIGN PATENT DOCUMENTS

| | | |
|---|---|---|
| JP | A-2-32950 | 2/1990 |
| JP | A-9-77074 | 3/1997 |
| JP | A-9-150834 | 6/1997 |
| JP | A-2004-59136 | 2/2004 |

* cited by examiner

*Primary Examiner* — Tri Mai
(74) *Attorney, Agent, or Firm* — Oliff & Berridge, PLC

(57) ABSTRACT

This invention is aimed at material saving and cost reduction. A technical problem to be solved by the invention is to provide a light-weight Y-shaped handle without impairing injection moldability and the functions of the handle. The principal means of solving the above-described technical problem is an injection molded handle used by being fitted and secured firmly to a rear portion of a body of a synthetic resin bottle by an insert molding method. The handle comprises a pair of fitting bent beams disposed in parallel in an upright posture and fitted by an undercut engagement to a rear portion of a body of a bottle, a grip plate in a vertical and long rectangular shape disposed between the pair of the fitting bent beams, and a circular gate area disposed at a center of the grip plate, wherein the thickness of the grip plate is reduced on both sides thereof in a certain height range to form thin plate portions, while leaving, as thick portions, a near-gate area including and surrounding the gate area in a concentric manner and vertical slip portions extending up- and downward from the near-gate area.

8 Claims, 8 Drawing Sheets

[Fig.1]
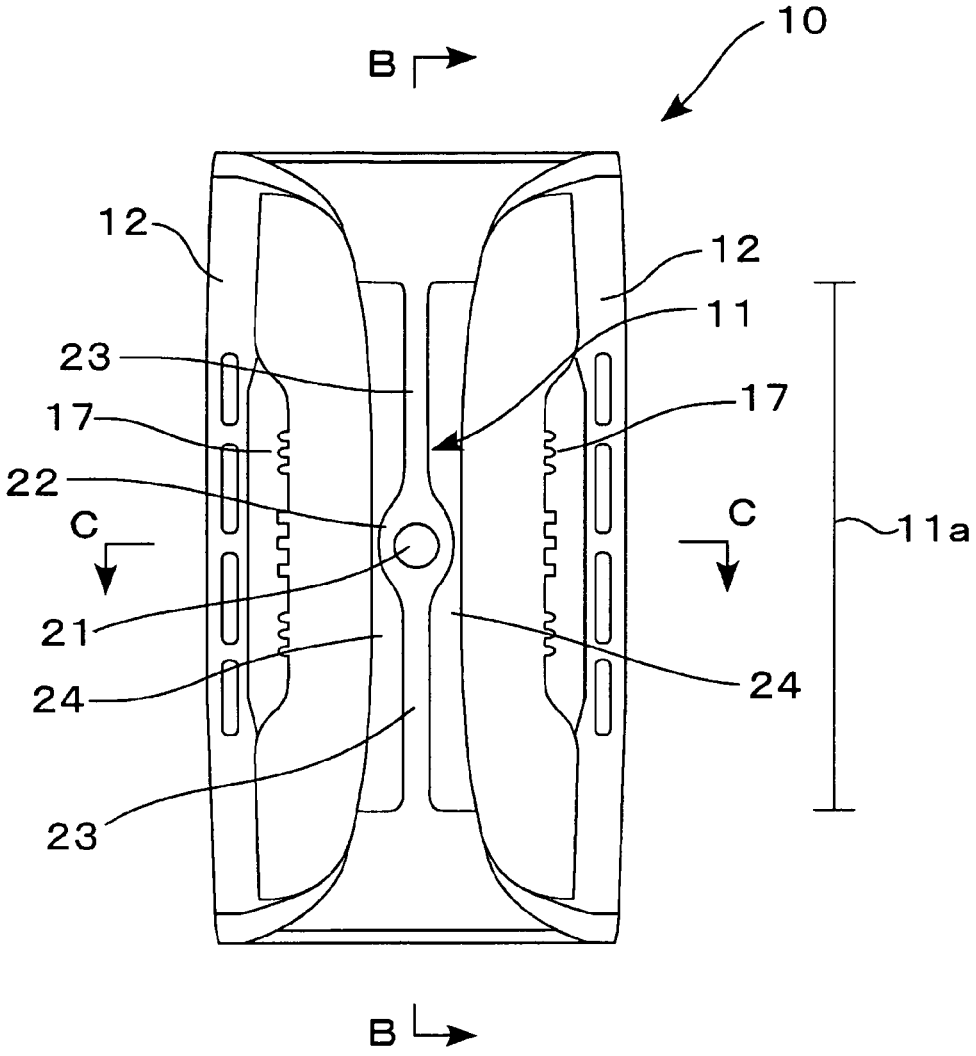

[Fig.2]
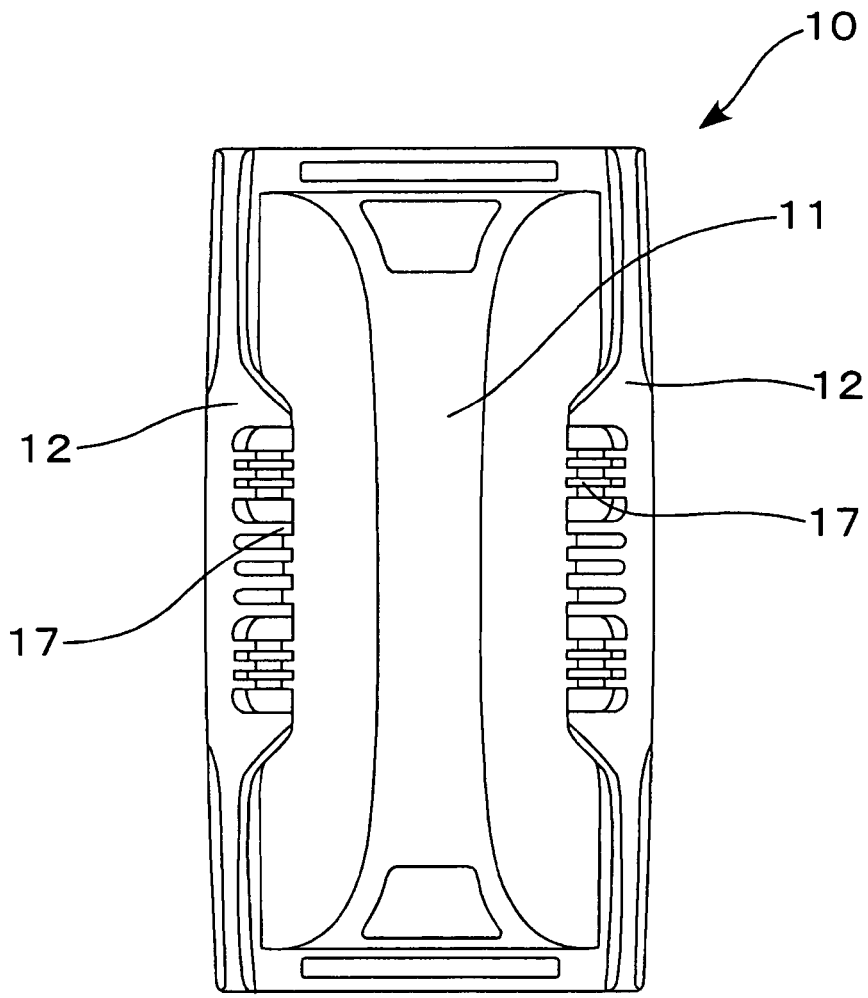

[Fig.3]
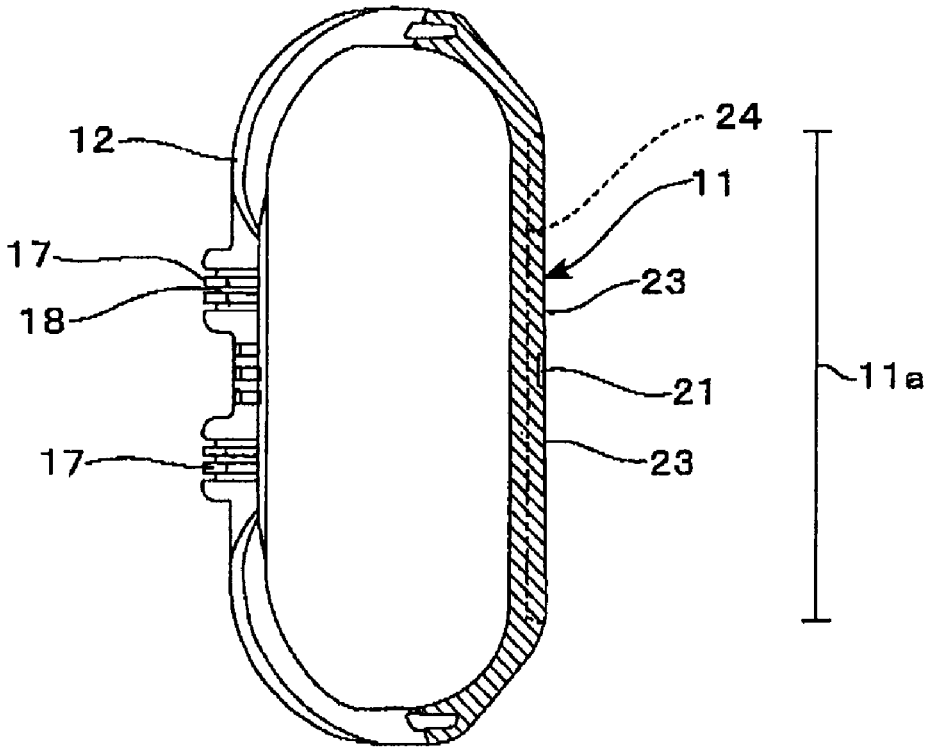

[Fig.4]
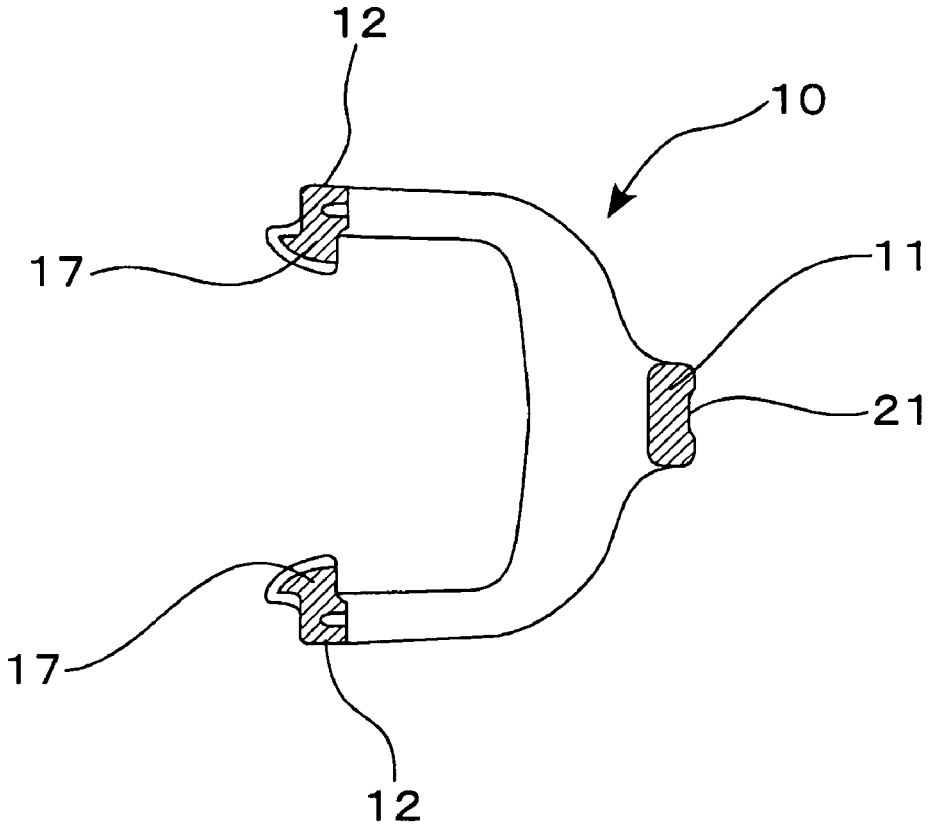

[Fig.5]
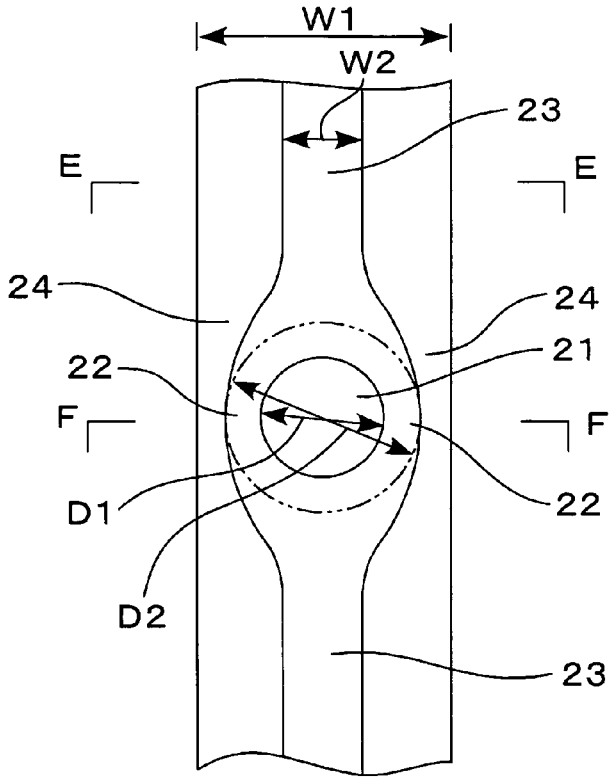
(a)
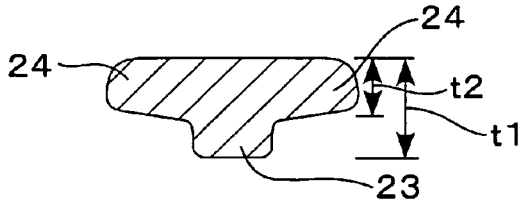
(b)
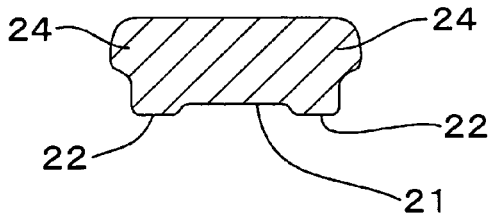
(c)

[Fig.6]
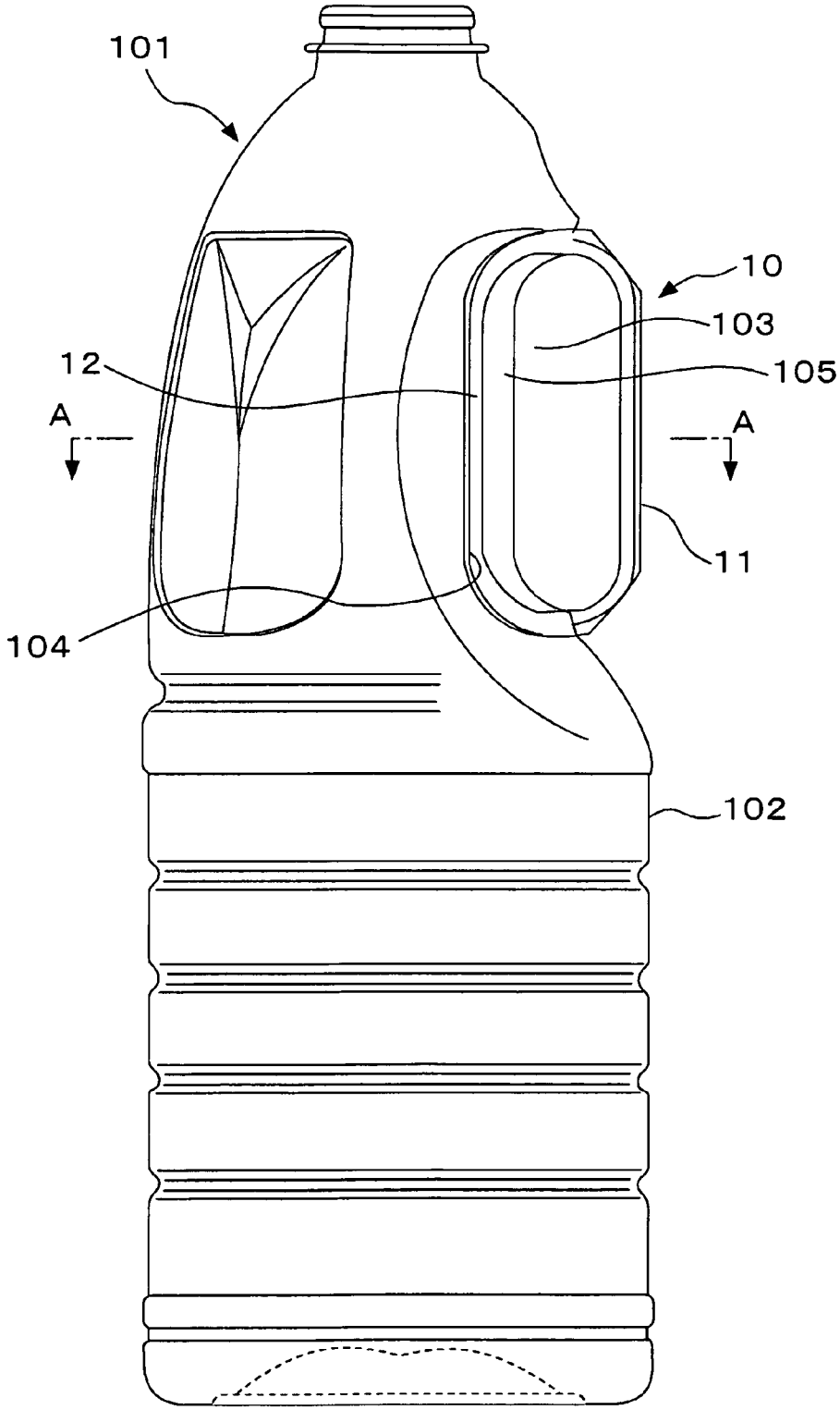

[Fig.7]
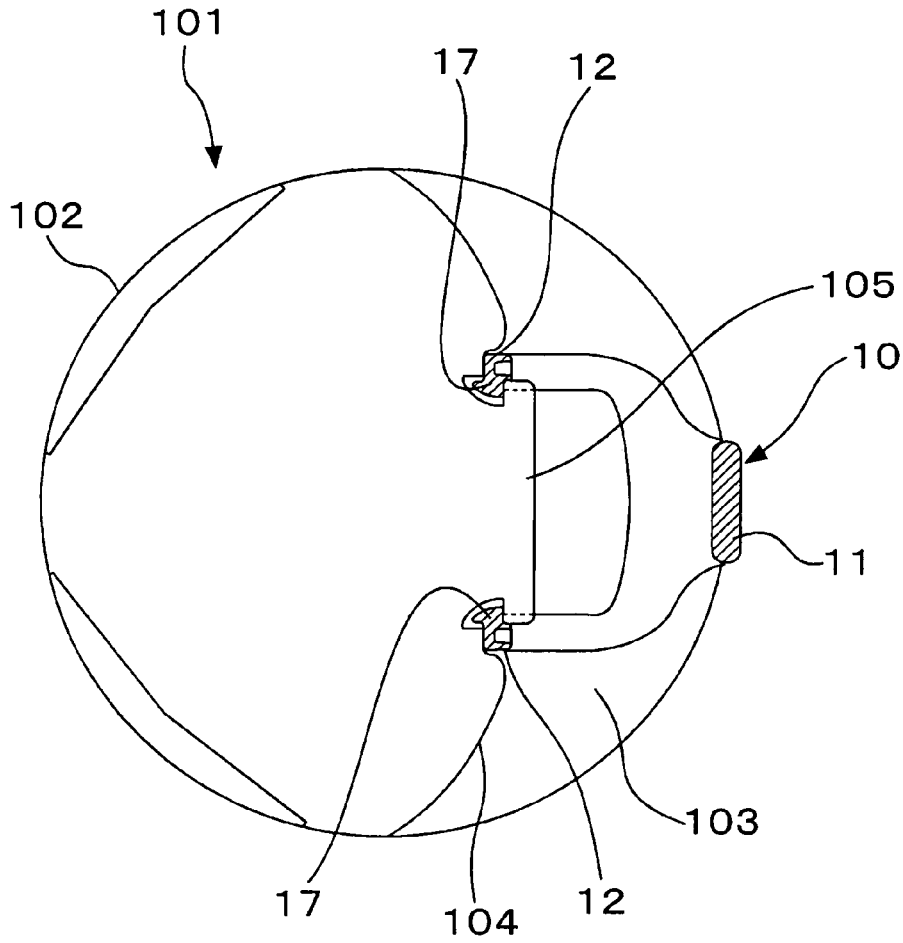

[Fig.8]
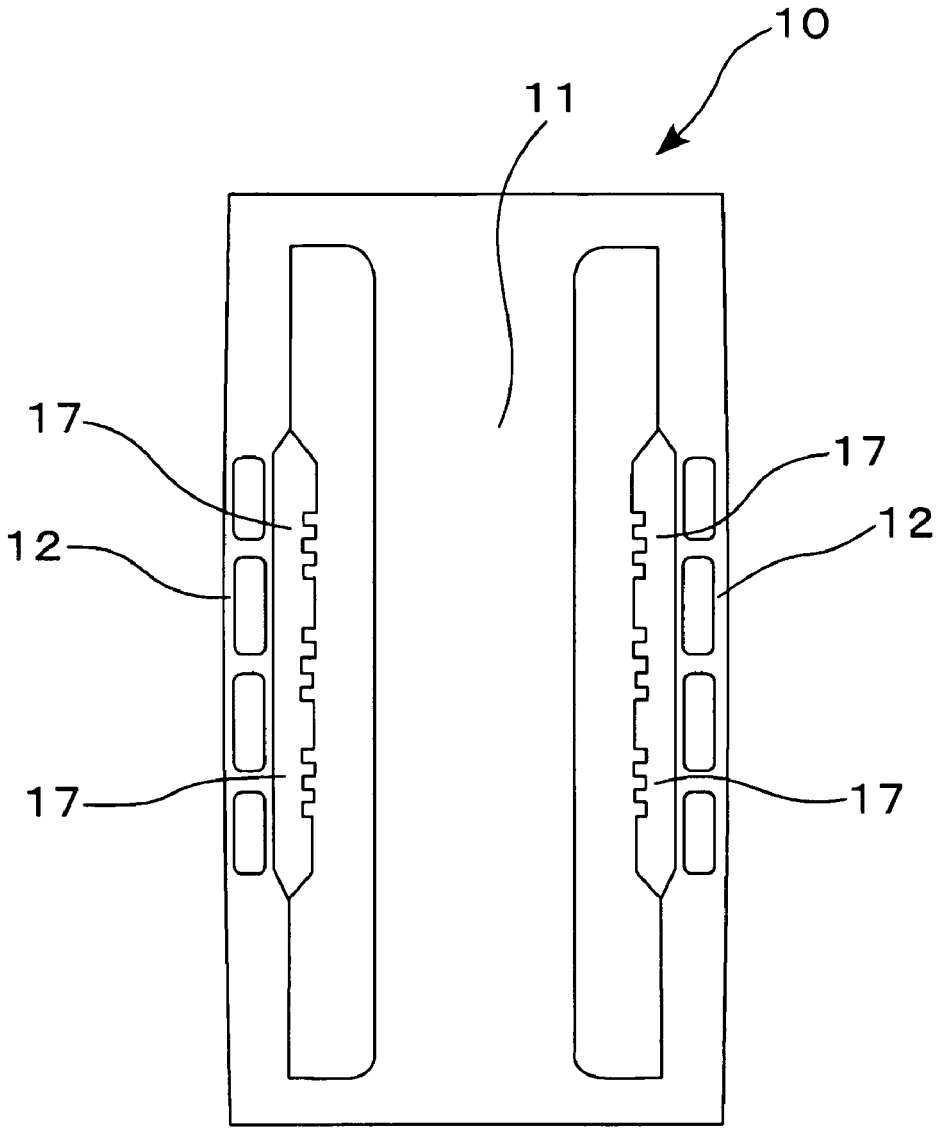

SYNTHETIC RESIN HANDLE FOR USE WITH A BOTTLE

TECHNICAL FIELD

This invention relates to a synthetic resin handle used by being fitted and secured firmly to a synthetic resin bottle by an insert molding method.

BACKGROUND ART

Patent document 1 describes a synthetic resin bottle with a handle manufactured by biaxially drawing and blow molding a bottle made of a polyethylene terephthalate resin (hereinafter referred to as PET) while utilizing, as an insert material, a handle that has been preliminarily injection molded into a certain shape. (See FIGS. 6-8.)

A bottle 101 has a recession 103 sunken at the rear of a body 102. A handle 10 has a so-called Y-shape (see FIG. 7 showing a plane cross-sectional view of the handle 10), and comprises a grip plate 11 integrally disposed in parallel between a pair of upper and lower fitting bent beams 12 in an upright posture. Embedded projecting pieces 17 are disposed at each fore-front of the fitting bent beam 12, and at the time of insert molding, are fitted by an undercut engagement to right and left portions of a wide, vertical projecting wall 105, which has been formed on a bottom of a recession 104 of the bottle 101, so that the handle 10 is fitted firmly to the bottle 101. Because a pair of fitting bent beams 12 is fitted and secured firmly to the bottle 101, the Y-shaped handle 10 can advantageously support the bottle 101 stably even when the bottle 101 is filled with liquid contents and has a heavy weight.

Patent document 1: Published patent application JP2004-059136

DISCLOSURE OF THE INVENTION

Problems to be Solved by the Invention

This invention is aimed at material saving and cost reduction. A technical problem to be solved by the invention is to provide a light-weight Y-shaped handle without impairing injection moldability and the functions of the handle.

Means of Solving the Problem

The means of carrying out the invention according to claim 1 to solve the above-described technical problem is an injection molded, so-called Y-shaped handle used by being fitted and secured firmly to a rear portion of a body of a synthetic resin bottle by an insert molding method. The handle comprises a pair of fitting bent beams disposed in parallel in an upright posture and fitted in an undercut engagement to the rear portion of the body, a grip plate in a vertical and long rectangular shape disposed between the pair of the fitting bent beams, and a circular gate area disposed in a central area of the grip plate, wherein the thickness of the grip plate is reduced on both sides thereof in a certain height range to form thin plate portions, while leaving, as thick portions, a near-gate area including and surrounding the gate area in a concentric manner and vertical slip portions extending up- and down-ward from the near-gate area.

Under the above construction of claim 1, weight saving can be achieved for the handle by forming thin plate portions on both sides of the grip plate while leaving the vertical slip portions intact. The vertical slip portions remain thick and serve as vertical ribs to make up for decreased rigidity caused by the thinned grip plate, i.e., the portion to be held with a hand.

In the case of Y-shaped handles of this type, a molten resin is injected from a nozzle of an injection molding machine, and is flowed into the gate area through a mold gate in a position opposed to the gate area at the center of the grip plate. Then, the resin flows through the portions of the mold cavity corresponding to the resulting grip plate in two directions: upward and downward. Each resin flow soon diverges into right and left ways at both of upper and lower ends, and the separate resin flows go through the portions becoming a pair of fitting bent beams. The resin flow coming from above joins the flow coming from below together at a middle height of the portions of the resulting pair of fitting bent beams. Thus, the resin enters the cavity through the gate area, flows upward and downward, diverges right and left, and goes half around to form a pair of loops, thus requiring a long flow distance.

In order for the weight saving to be achieved, it would be necessary to give consideration to resin flowability if reduced thickness is given to an element of a molded product. Under the construction of the invention according to claim 1, some weight saving of the grip plate is achieved by reducing the thickness of the grip plate partially. In that case, it is ensured that the near-gate area, including and surrounding the gate area in a concentric manner, is kept from reducing the thickness. If this is done, then decreases in temperature and pressure can be controlled for the molten resin flowing into the gate area through the mold gate. Thus, the molten resin can be supplied smoothly in both the upward and downward directions.

In addition, the vertical slip portions remain to be thick through to the upper and lower ends of the flat plate portion, i.e., in the directions of resin flows. Since the slip portions run along a vertical center line of the grip plate and extend upward and downward from the near-gate area, these portions help effectively control the decreases in temperature and pressure of the resin flowing through the portion corresponding to the resulting grip plate, and allow the resin to move smoothly toward the upper and lower ends of the grip plate portion once the resin has been supplied from the near-gate area upward and downward. On the whole, the remaining thick portions can make up for a decrease in resin flowability caused by the thin portions of the grip plate, and effectively secure injection moldability of the Y-shaped handle having a long flow distance.

The diameter of the near-gate area, the width and height range of the vertical slip portions, and the extent to which the grip plate is thinned can be determined by taking into consideration the effect of weight saving and the injection moldability. Although there is no limitation to the shape of the near-gate area, it is preferred that in principle, this area is designed to be substantially concentric with the circular gate area.

The means of carrying out the invention of claim 2 comprises that, in the invention of claim 1, the near-gate area has a diameter 1.3 times or more, and preferably 1.5 times or more, the diameter of the gate area.

Under the construction of claim 2, the decrease in resin temperature and pressure in the near-gate area can be effectively controlled by setting the diameter of the near-gate area at 1.3 times or more, and preferably 1.5 times or more, the diameter of the gate area.

The means of carrying out the invention of claim 3 comprises that, in the invention of claim 1 or 2, the vertical slip portions has a lateral width 0.3 times or more, and preferably 0.5 times or more, the diameter of the gate area.

Under the above construction of claim 3, the resin supplied from the gate area can be flowed smoothly toward the upper and lower ends of the resulting grip plate, by setting the lateral width of the vertical slip portions at 0.3 times or more, and preferably 0.5 times or more, the diameter of the gate area.

The means of carrying out the invention of claim 4 comprises that in the invention of claim 1, 2, or 3, the handle is made of a PET resin.

Although the handle made of a PET resin is highly rigid, the handle is relatively brittle as compared to, e.g., a handle made of a polypropylene resin. If the entire grip plate is made thin, there might be crack development when sudden force acts on the grip plate. Under the above construction of claim 4, the vertical slip portions remaining thick can withstand such force so that any crack can be prevented effectively from occurring.

Effects of the Invention

This invention having above construction has the following effects:

According to the invention of claim 1, the thick vertical slip portions perform the function of vertical ribs and can make up for decreased rigidity caused by the thinned grip plate to be held with a hand.

The near-gate area also performs the function of controlling the decreases in the temperature and pressure of molten resin flowing in through the gate area, and from the near-gate area, the supplied resin can be smoothly flowed through to the upper and lower ends of the resulting grip plate, by leaving the vertical slip portions to be thick along the direction of resin flow. On the whole, the portions remaining thick can make up for a decrease in resin flowability caused by the thin portions of the grip plate, and effectively secure injection moldability of the Y-shaped handle having a long flow distance.

According to the invention of claim 2, the decreases in resin temperature and pressure in the near-gate area can be effectively controlled by setting the diameter of the near-gate area at 1.3 times or more, and preferably 1.5 times or more, the diameter of the gate area.

According to the invention of claim 3, the resin supplied from the gate area can be flowed smoothly toward the upper and lower ends of the resulting grip plate, by setting the lateral width of the vertical slip portions at 0.3 times or more, and preferably 0.5 times or more, the diameter of the gate area.

According to the invention of claim 4, the vertical slip portions remaining thick can withstand the action of force so that any crack can be prevented effectively from occurring in the PET resin handle having a relatively brittle property.

BRIEF DESCRIPTION OF THE DRAWINGS

FIG. 1 is a rear view showing the handle in one embodiment of this invention.

FIG. 2 is a front view of the handle shown in FIG. 1.

FIG. 3 is a vertical section of the handle taken from line B-B in FIG. 1.

FIG. 4 is a plane cross-sectional view of the handle taken from line C-C shown in FIG. 1.

FIG. 5 are enlarged views of important parts of the grip plate of the handle, in which FIG. 5(*a*) is a rear view; FIGS. 5(*b*) and 5(*c*) are plane cross-sectional views taken respectively from line E-E and line F-F shown in FIG. 5(*a*).

FIG. 6 is an entire side view of an example of the synthetic resin bottle with a handle.

FIG. 7 is a plane cross-sectional view of the synthetic resin bottle with a handle taken from line A-A shown in FIG. 6.

FIG. 8 is a front view of the handle shown in FIG. 7.

DESCRIPTION OF REFERENCE SIGNS

10. Handle
11. Grip plate
11*a*. Flat plate portion
12. Fitting bent beam
17. Embedded projecting piece
18. Lateral groove
21. Gate area
22. Near-gate area
23. Vertical slip portion
24. Thin plate portion
101. Bottle
102. Body
103. Recession
104. Bottom of recession
105. Vertical projecting wall
W1, W2. Lateral width
D1, D2. Diameter
t1, t2. Plate thickness

A PREFERRED EMBODIMENT OF THE INVENTION

This invention is further described with respect to a preferred embodiment, now referring to the drawings. FIGS. 1-5 show the handle in an embodiment of this invention, in which FIG. 1 is a rear view; FIG. 2, a front view; FIG. 3, a vertical section taken from line B-B in FIG. 1; FIG. 4, a plane cross-sectional view taken from line C-C shown in FIG. 1; and FIG. 5, enlarged views of important parts of the grip plate of the handle, in which FIG. 5(*a*) is a rear view; FIGS. 5(*b*) and 5(*c*) are plane cross-sectional views taken respectively from line E-E and line F-F shown in FIG. 5(*a*).

This handle 10 is an injection molded product made of a PET resin. It is set in a blow mold as an insert material, and is fitted and secured firmly to the rear of a PET resin bottle 101 at the time of a biaxial drawing and blow molding operation. (See FIG. 6.)

The handle 10 comprises a grip plate 11 in the form of a vertical plate, a pair of fitting bent beams 12 connected to upper and lower bent ends of the grip plate 11 and disposed in parallel at positions opposed to each other, and embedded projecting pieces 17 disposed at each forefront of the pair of fitting bent beams 12 and connected to a recession bottom 104 of the bottle 101 in an undercut engagement. As found from FIG. 3, a pair of the embedded projecting pieces 17 is disposed vertically on each fitting bent beam 12 in this embodiment (See FIG. 7). In addition, a plurality of lateral grooves 18 is also formed, taking into consideration the slidability of the PET resin which is drawn and molded at the time of insert molding.

There is a circular gate area 21 in the central area at the rear of a rectangular flat plate portion 11*a* where the grip plate 11 is disposed standing upright (See FIGS. 1 and 3). A near-gate area 22 is disposed to include and surround the gate area 21 in a concentric manner (See a circle drawn by a chain double-dashed line in FIG. 5(*a*)). Furthermore, vertical slip portions 23 extend up- and down-ward from the near-gate area 22. The thickness of the grip plate is reduced on both right and left sides of the flat plate portion 11*a* to form thin plate portions 24, while leaving, as thick portions, the near-gate area 22 and the vertical slip portions 23.

Plate thickness was reduced to obtain the thin portions 24, and to form the handle 10 having a weight of 12.5 g. This reduction in plate thickness resulted in the weight saving of 2.6 g. In this embodiment, the flat plate portion 11*a* of the handle 10 has the following dimensions:

(1) The flat plate portion 11*a* has a height of 58 mm and a lateral width W1 of 10 mm (except for the upper and lower ends where the width is somewhat expanded)

(2) The vertical slip portions 23 and the near-gate area 22 have a thickness t1 of 4 mm.

(3) The thin plate portions 24 have an average thickness t2 of 2.25 mm.

(4) The gate area 21 has a diameter D1 of 5 mm, and the near-gate area 22 has a diameter D2 of 8 mm (D2/D1=1.6).

(5) The vertical slip portions 23 have a lateral width W2 of 3 mm (W2/D1=0.6). If resin flowability is taken into consideration, it is preferred that the lateral width is changed gradually at the connections between the near-gate area 22 and the vertical slip portions 22, as found in this embodiment.

The above-described handle 10 could have been injection molded easily under normal conditions without any short shot. The handle 10 was used as an insert material to form a biaxially drawn, blow molded PET resin bottle having a nominal capacity of 1.8 liters. The bottle was filled with contents to check on whether or not this handle 10 is useful for the user to hold the bottle firmly with a hand. Owing to the vertical rib function fully performed by the vertical slip portions 23 which has remained thick, the handle 10 showed a good gripping property, and could bear the weight of the bottle filled with the contents.

Although the synthetic resin handle of this invention has been described above with respect to a preferred embodiment, it should be noted that this invention is not limited to this embodiment. For example, the resin to be used is not limited to the PET resin, but other resins, including polypropylene resins, can also be used. As regards the embedded projecting pieces used to achieve an undercut engagement, there are various shapes and structures that can be employed in this invention.

The diameter D2 of the near-gate area and the lateral width W2 of the vertical slip portions can be determined arbitrarily in a comparison with the diameter D1 of the gate area and the lateral width W1 of the grip plate 11, while taking a target weight saving effect and injection moldability into consideration. Although there is no limitation to the shape of the near-gate area, it is preferred to use, as a standard, a circular shape that is concentric with the circular gate area and to design a shape by deforming that shape appropriately.

INDUSTRIAL APPLICABILITY

The synthetic resin handle of this invention is as described above. The weight saving for the handle can be achieved by reducing the thickness of the grip plate without impairing the injection moldability and the bottle gripping property. The handle of this invention is expected to have a wide range of applications as being used with biaxially drawn, blow molded bottles.

The invention claimed is:

1. An injection molded synthetic resin handle used by being fitted and secured firmly to a rear portion of a body of a synthetic resin bottle by an insert molding method, the handle comprising:

a pair of fitting bent beams disposed in parallel in an upright posture and fitted to a rear portion of the body by an undercut engagement;

a grip plate in a vertical and long rectangular shape disposed between the pair of the fitting bent beams; and a circular gate area disposed at a center of a rear side of the grip plate, the gate area corresponding to an area into which molten resin flows into a mold from a nozzle of an infection molding machine during injection molding, wherein the thickness of the grip plate is reduced on both sides thereof in a certain height range to form thinner plate portions, and the grip plate is provided with thicker portions between the thinner plate portions, the thicker portions comprising a near-gate area including and surrounding the gate area in a concentric manner and vertical slip portions extending upward and downward from the near-gate area.

2. The synthetic resin handle according to claim 1 wherein the near-gate area has a diameter 1.3 times or more the diameter of the gate area.

3. The synthetic resin handle according to claim 1 wherein the vertical slip portions has a lateral width 0.3 times or more the diameter of the gate area.

4. The synthetic resin handle according to claim 1 wherein the handle is made of a polyethylene terephthalate resin.

5. The synthetic resin handle according to claim 2, wherein the vertical slip portions have a lateral width 0.3 times or more the diameter of the gate area.

6. The synthetic resin handle according to claim 2, wherein the handle is made of a polyethylene terephthalate resin.

7. The synthetic resin handle according to claim 3, wherein the handle is made of a polyethylene terephthalate resin.

8. An injection molded synthetic resin handle according to claim 1, wherein the circular gate area is disposed at a center of the rear side of a rectangular flat plate portion of the grip plate where the grip plate is disposed standing upright.

* * * * *